US005919591A

United States Patent [19]

Senba et al.

[11] Patent Number: 5,919,591

[45] Date of Patent: Jul. 6, 1999

[54] ELECTROPHOTOGRAPHIC PHOTOCONDUCTOR AND METHOD OF MANUFACTURING THE SAME

[75] Inventors: Naoyuki Senba; Toshio Tsubota, both of Nagano, Japan

[73] Assignee: Fuji Electric Co., Ltd., Kawasaki, Japan

[21] Appl. No.: 08/908,660

[22] Filed: Aug. 7, 1997

[30] Foreign Application Priority Data

Aug. 7, 1996 [JP] Japan ..... 8-207493

[51] Int. Cl.[6] ..... G03G 5/10; G03G 5/14

[52] U.S. Cl. ..... 430/65; 430/69; 430/127; 430/131

[58] Field of Search ..... 430/69, 127, 65, 430/131

[56] References Cited

U.S. PATENT DOCUMENTS

| | | | |
|---|---|---|---|
| 4,936,948 | 6/1990 | Okhi et al. | 156/645 |
| 5,080,993 | 1/1992 | Maruta et al. | 430/69 |
| 5,573,445 | 11/1996 | Rasmussen et al. | 430/127 |

FOREIGN PATENT DOCUMENTS

| | | | |
|---|---|---|---|
| 59-058436 | 4/1984 | Japan | 430/69 |
| 2-105161 | 4/1990 | Japan | 430/127 |
| 973683 | 10/1964 | United Kingdom | 430/69 |

*Primary Examiner*—Roland Martin
*Attorney, Agent, or Firm*—Baker & Botts, L.L.P.

[57] ABSTRACT

An electrophotographic photoconductor includes an electrically conductive substrate in the form of a cylindrical tube, the substrate having an outer surface roughened by dry-blasting to a maximum surface roughness of about 5 μm or less, and a photoconductive layer on the substrate. Preferably, the substrate is aluminum or an aluminum alloy and has an inner diameter and a thickness related to each other in a ratio of inner diameter to thickness of 75 or less. The substrate preferably has not been preliminarily finished by cutting. Preferably, the electrophotographic photoconductor comprises an oxide film between the substrate and the photoconductive layer, the oxide film covering 75% or more of the outer surface of the substrate. In a preferred embodiment, the electrophotographic photoconductor further comprises an undercoating layer between the oxide film and the photoconductive layer, the undercoating layer composed substantially of an organic resin and having a thickness of about 5 μm or less. According to another embodiment of the invention, there is provided a method of manufacturing an electrophotographic photoconductor, the electrophotographic photoconductor comprising an electrically conductive substrate in the form of a cylindrical tube, the method including the steps of: roughening by dry-blasting the outer surface of the substrate to a maximum surface roughness of about 5 μm or less using abrasives with a grain size of about #500 or finer; and forming a photoconductive layer on the roughened outer surface.

6 Claims, 2 Drawing Sheets

ELECTROPHOTOGRAPHIC PHOTOCONDUCTOR AND METHOD OF MANUFACTURING THE SAME

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to an electrophotographic photoconductor and to a method of manufacturing the substrate for the electrophotographic photoconductor.

Electrophotographic techniques, developed at first for copying machines, are now applied also to laser printers, since electrophotographic techniques facilitate printing with higher printing quality, at higher printing speed and with less audible noise than by conventional impact printing techniques.

FIG. 4 is a partial cross-sectional view of a conventional electrophotographic photoconductor. Referring now to FIG. 4, the electrophotographic photoconductor includes a cylindrical tubular substrate 1 made of aluminum or other such conductive material. A machined surface 1*a* is formed on the substrate 1 by cutting, grinding, polishing or other such surface machining technique. An undercoating layer 2, that includes an anodized oxide film or an organic resin film, is formed on the machined surface 1*a*. A photoconductive layer 3 is formed on the undercoating layer 2 by laminating a charge generation layer 3*a* and a charge transport layer 3*b*, which include photoconductive materials. The undercoating layer 2, the charge generation layer 3*a*, and the charge transport layer 3*b*, each including an organic resin film, are formed through a series of dip-coating processes.

Pure aluminum or aluminum alloy tubing has been mainly used for the substrate. In addition, various surface machining and treatment techniques and various finishing techniques, including provision for an undercoating layer, have been proposed for the substrate. The proposed techniques include cutting with a turning tool, grinding with an abrasive tape or an abrasive wheel, buffing, honing, and chemical polishing. (See Japanese Unexamined Laid Open Patent Applications No. S59-74567, No. S60-112049, No. S61-42663, No. S62-186270, No. H01-316752, No. H04-269760, and No. H04-300163.)

Recently, aluminum tubing (or porthole tubing), the surface of which has not been finished by cutting, has been widely used due to the recent technological development in the tubing manufacture and due to the rationalization of the surface finishing of the tubing. The specified surface state and dimensional precision of this tubing can be attained by drawing or by ironing the tubing manufactured by extrusion. However, small flaws or pits may be caused in the photoconductive layer of the photoconductor by the stripes, specific to the porthole tubing, along the cylindrical axis of the tubing. In addition, residual surface stress caused by drawing remains. Further, the degree of oxidation and wettability of the tubing surface exhibit wide distributions. In addition, it is difficult to remove the highly viscous oil used in the drawing process. These defects of the substrate surface make it difficult to obtain a photoconductive layer with uniform film quality and thickness. The surface defects of the substrate also cause uneven color in the external appearance of the photoconductor and uneven printing density in the image quality.

The cost of the substrate occupies a very large portion of the manufacturing costs of a high-quality photoconductor, which includes a photoconductive layer with a uniform film thickness and quality. The substrate is costly because it is necessary to apply a variety of finishing processes to the substrate surface, such as preliminary cutting, polishing and, depending on the structure of the photoconductive layer, forming of an anodized oxide film on the substrate surface.

Recently, the finishing processes of the substrate have been further individualized and complicated as varieties of substrate material and tubing have been used. Tiny irregularities in a finishing process causes nonuniformity in the film thickness and film quality of the photoconductive layer. The nonuniformity in the film thickness and film quality of the photoconductive layer causes an unfavorable external appearance of the photoconductor such as uneven color and luster; unwanted image defects such as black spots, voids and uneven printing density; and unfavorable electrical performances such as irregular charge retention and poor repeatability.

Accordingly, there exists a need to provide a simplified method of manufacturing a substrate for an electrophotographic photoconductor at a low cost.

BRIEF SUMMARY OF THE INVENTION

In view of the foregoing, it is an object of the invention to provide a simplified method of manufacturing a substrate for an electrophotographic photoconductor at a low manufacturing cost. It is another object of the invention to provide a photoconductor substrate with an excellent finished surface. It is still another object of the invention to provide a photoconductive layer with uniform film thickness and film quality. It is a further object of the invention to provide an electrophotographic photoconductor with an excellent external appearance that facilitates the prevention of image defects and irregular electrical performance.

According to an aspect of the invention, there is provided an electrophotographic photoconductor comprising an electrically conductive substrate in the form of a cylindrical tube, the substrate having an outer surface roughened by dry-blasting to a maximum surface roughness of about 5 $\mu$m or less, and a photoconductive layer on the substrate.

In a preferred embodiment of the invention, the substrate is aluminum or an aluminum alloy and has an inner diameter and a thickness related to each other in a ratio of inner diameter to thickness of 75 or less. Preferably, the substrate has not been preliminarily finished by cutting. The electrophotographic photoconductor preferably comprises an oxide film between the substrate and the photoconductive layer, the oxide film covering 75% or more of the outer surface of the substrate. Preferably, the electrophotographic photoconductor further comprises an undercoating layer between the oxide film and the photoconductive layer, the undercoating layer composed substantially of an organic resin and having a thickness of about 5 $\mu$m or less.

According to another embodiment of the invention, there is provided a method of manufacturing an electrophotographic photoconductor, the electrophotographic photoconductor comprising an electrically conductive substrate in the form of a cylindrical tube, the method comprising: roughening by dry-blasting the outer surface of the substrate to a maximum surface roughness of about 5 $\mu$m or less using abrasives with a grain size of about #500 or finer; and forming a photoconductive layer on the roughened outer surface.

Since the outer surface of the substrate is roughened finely and regularly by dry-blasting, the nominal outer surface area is increased as compared with that before the application of the dry-blasting. Accordingly, the adhesiveness between the substrate and a layer formed on the substrate is improved. In addition, the wet angle is reduced as compared with that before the application of the dry-blasting and the coating liquid for the subsequent film formation spreads more easily over the outer surface of the substrate. Therefore, a film formed directly on the roughened outer surface is formed uniformly and stably without any resulting unevenness in the film thickness. Further, the degree of oxidation of the roughened outer surface is increased, i.e., an oxide film as uniform as a conventional undercoating layer is formed by the roughening work of the invention. Accordingly, a photoconductive layer, uniform in quality and film thickness and as stable as conventional layers, may be obtained without adding any undercoating layer. Alternatively, an undercoating layer, thinner than a conventional one, may be added between the roughened outer surface of the substrate and the photoconductive layer.

DETAILED DESCRIPTION OF THE INVENTION

The surface of photoconductor substrate of the invention is roughened by dry-blasting to have a fine and regular surface structure. The substrate of the invention is extremely suitable for laminating thereon an organic photoconductive layer by dip-coating.

When aluminum tubing is used for the substrate, it is necessary to set the ratio of the inner diameter to the tube thickness to be 75 or less, since the substrate tubing may be deformed in the dry-blasting process under the blasting pressure of the abrasives when the ratio is larger than 75. The aluminum tubing can be used with no problems as long as the maximum surface roughness (Rmax) is 5 $\mu$m or less and the average surface roughness for 10 points (Rz) is 3 $\mu$m or less even when pitting defects, 200 $\mu$m or less in width and 4 $\mu$m or less in depth, are scattered.

The maximum surface roughness (Rmax) was measured by the non-contact method, and the average surface roughness for 10 points (Rz) by the contact method. The non-contact method uses a monochromatic light such as a laser beam and measures the height of the pit by the focused point spacing between the bottom of the concave portion and the top of the convex portion under a microscope. The contact method measures the surface roughness by means of the vertical movement of a prove scanning the rough surface.

When an aluminum tubing, the surface of which has not been finished by cutting, is used, excellent surface roughening is facilitated by preliminary roller varnishing. Now the present invention will be explained hereinafter with reference to the accompanying drawings, FIGS. 1 to 3.

Figure 1:
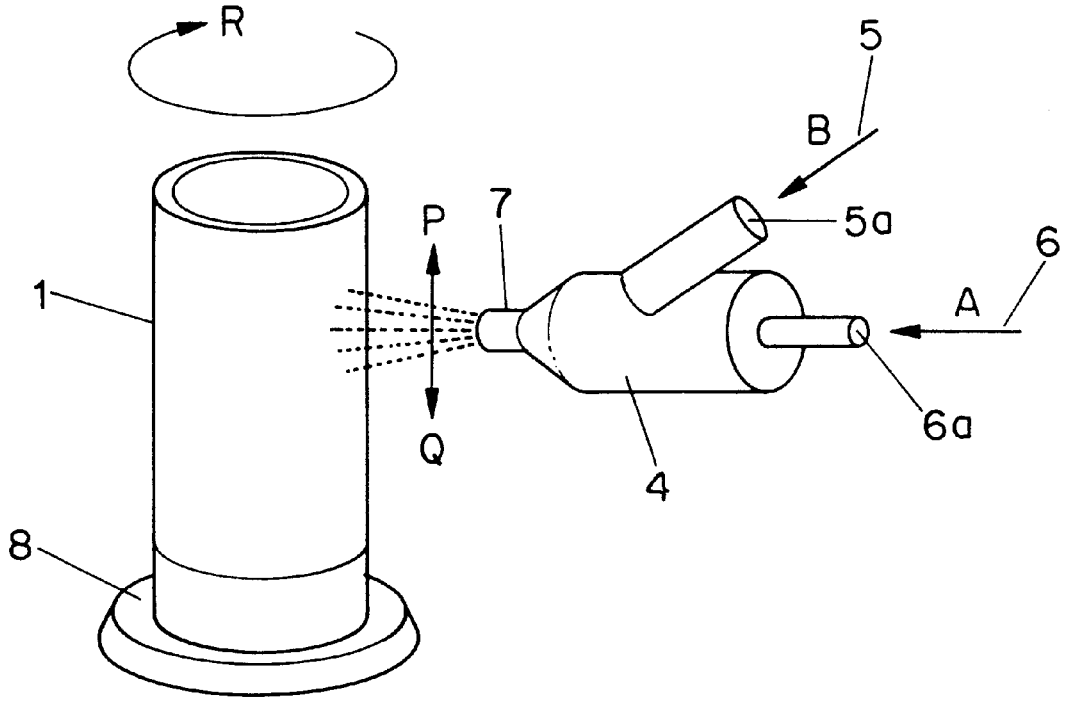
FIG. 1 is an isometric view of an embodiment of a substrate and dry-blasting apparatus in accordance with the invention.

FIG. 1 is an isometric view of an embodiment of the substrate and the dry-blasting apparatus according to the invention. Referring now to FIG. 1, a conductive cylindrical tubular substrate 1 is fixed at an end thereof on a rotating table 8. The substrate 1 is rotated around the cylindrical axis thereof in the rotating direction indicated by an arrow R at a predetermined rotation rate (from 50 to 200 rpms.). A blasting nozzle 4 includes a nozzle head 7 positioned a predetermined distance (from 4 to 20 cm) from the substrate 1 and movable in the axial direction indicated by an arrow PQ. The blasting nozzle 4 also includes an abrasive feeder 5*a* and a compressed air feeder 6*a*. The surface roughening treatment is performed by feeding abrasives 5 with a grain size of #500 or finer through the abrasive feeder 5*a*, as shown by an arrow B; by feeding compressed air through the air feeder 6*a*, as shown by an arrow A; and by blasting the abrasives 5 to the surface of the substrate 1 under a predetermined blasting pressure (from 1 to 5 kg/cm$^2$) while moving the nozzle head 7 at a predetermined speed (from 3 to 20 mm/sec).

Effective abrasives for the dry-blasting include alumina, Carborundum, glass particles, and synthetic resin. Alumina is especially preferable when aluminum tubing is used for the substrate. When the abrasive grain size is too large, it is difficult to obtain a flat photoconductive layer, since the substrate surface treated by blasting is so rough that the maximum surface roughness exceeds 5 $\mu$m. Even worse, rough abrasive grains stick to the substrate surface causing convex film defects, which further cause image defects such as black spots and voids.

By the dry-blasting work, the surface of the aluminum tubing is shaved with the abrasives and the temperature of the aluminum tubing surface is raised by the impact energy of the abrasives. The rising surface temperature of the aluminum tubing facilitates forming a new natural oxide film on the shaved surface of the aluminum tubing. The degree of oxidation, measured as the index of oxide film formation, was 67% before the blasting work and 75% after the blasting work. It has also been observed that the wider oxide film coverage on the substrate surface facilitates preventing charge injection from the substrate to the photoconductive layer. The degree of oxidation was determined by measuring the rate of coverage of the oxide film over the outer surface of the substrate by X-ray photoelectron spectroscopy for chemical analysis (ESCA).

Figure 2:
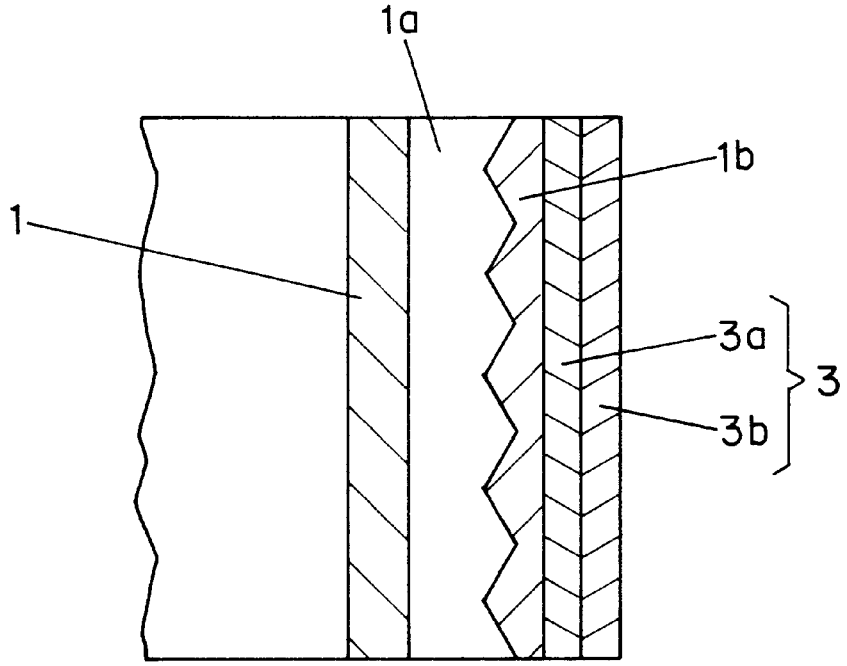
FIG. 2 is a cross-sectional view of an embodiment of an electrophotographic photoconductor in accordance with the invention that does not include an undercoating layer.

FIG. 2 is a cross-sectional view of an embodiment of a photoconductor according to the invention that does not include an undercoating layer. Referring now to FIG. 2, a substrate 1 includes a machined surface 1*a*. An oxide film 1*b* is formed on the machined surface 1*a* simultaneously when the machined surface 1*a* is formed on the substrate by the roughening surface treatment. A charge generation layer 3*a* on the oxide film 1*b* and a charge transport layer 3*b* on the charge generation layer 3*a* constitute a photoconductive layer 3. The charge generation layer 3*a* and charge transport layer 3*b* are laminated by dip-coating.

Figure 3:
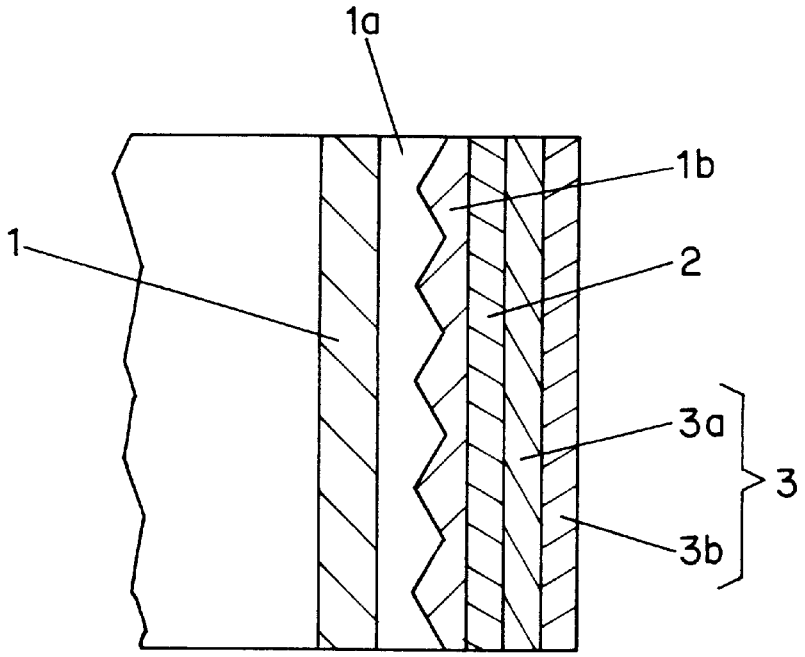
FIG. 3 is a cross-sectional view of an embodiment of an electrophotographic photoconductor in accordance with the invention that includes an undercoating layer.
Figure 4:
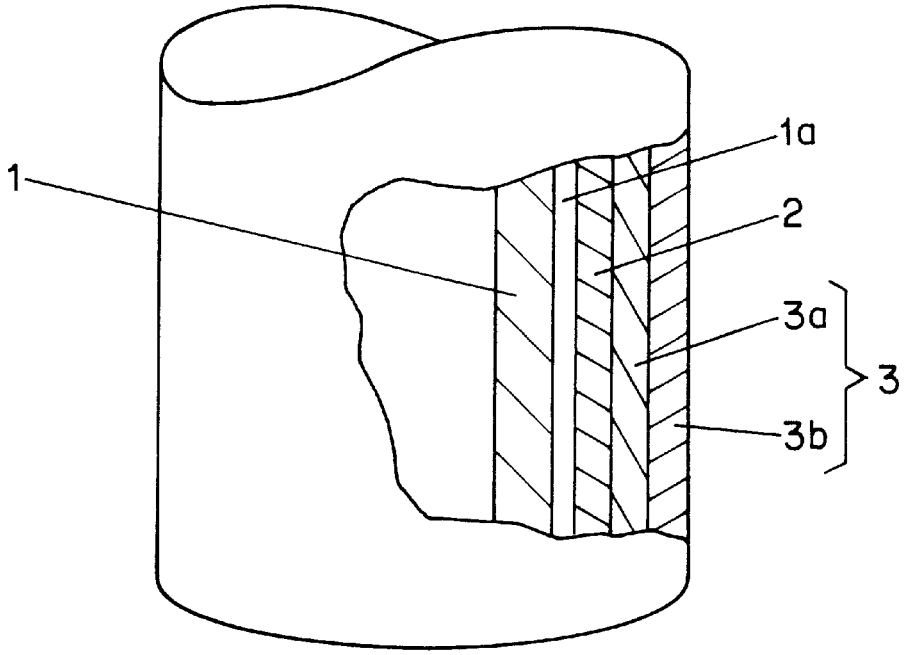
FIG. 4 PRIOR ART
FIG. 4 is a partial cross-sectional view of a conventional electrophotographic photoconductor.

FIG. 3 is a cross-sectional view of an embodiment of a photoconductor according to the invention that includes an undercoating layer. Referring now to FIG. 3, a substrate 1 includes a machined surface 1*a*. An oxide film 1*b* is formed on the machined surface 1*a* simultaneously when the machined surface 1*a* is formed on the substrate by roughening surface treatment. An undercoating layer 2 is formed on the oxide film 1*b*. A charge generation layer 3*a* on the undercoating layer 2 and a charge transport layer 3*b* on the charge generation layer 3*a* constitute a photoconductive layer 3. The charge generation layer 3 *a* and charge transport layer 3*b* are laminated by dip-coating. An additional undercoating layer may be formed when serious technical hazard remains in suppressing the charge injection.

First sample embodiment (E1)

An aluminum tubing, 0.75 mm in thickness and 30 mm in inner diameter, was cut to be 254 mm in length. The aluminum substrate was cleaned with weak alkaline aqueous solvent (pH=8) to remove oil and grease from the aluminum substrate. The surface of the aluminum substrate was roughened with a dry-blasting apparatus as shown in FIG. 1.

The entire outer surface of the substrate 1 was roughened with alumina abrasives with a grain size of #4000 by keeping the nozzle head 7 a distance of 5 cm away from the outer surface of the substrate 1 which was set to rotating at 60 rpms. The nozzle head 7 was moved at 4 mm/sec along the axial direction of the substrate, and the abrasives 5 were blasted under a blasting pressure of 4 kg/cm$^2$ onto the outer surface of the substrate. A photoconductive layer for the photoconductor of the first sample embodiment was obtained by laminating, by dip-coating, an undercoating layer 2 of 4 $\mu$m in thickness on the roughened surface 1*a*, a charge generation layer 3*a* of 0.3 $\mu$m in thickness on the undercoating layer 2, and a charge transport layer 3*b* of 20 $\mu$m in thickness on the charge generation layer 3*a*.

The machined surface 1*a* of the substrate 1 of the first sample embodiment was found by visual observation to be finely roughened and lusterless gray. It was found that stripes specific to the porthole tubing disappeared. No residual trace of the abrasive grains on the substrate surface was found under a laser microscope. The maximum surface roughness (Rmax) measured by the non-contact method was 1.1 $\mu$m, and the average surface roughness for 10 points (Rz) measured by the contact method was 0.08 $\mu$m.

Second sample embodiment (E2)

A photoconductor of a second sample embodiment was fabricated in the same manner as the photoconductor of the first sample embodiment except that an undercoating layer was not formed and the charge transport layer was formed to be 25 $\mu$m in thickness in the second sample embodiment.

The measurements of the roughened surface of the substrate of the second sample embodiment were the same as those of the roughened substrate surface of the first sample embodiment.

Third sample embodiment (E3)

A photoconductor of a third sample embodiment was fabricated in the same manner as the photoconductor of the first sample embodiment except that the entire outer surface of the substrate 1 for the third sample embodiment was roughened with Carborundum abrasives with a grain size of #1500 by keeping the nozzle head 7 10 cm away from the outer surface of the substrate 1, by moving the nozzle head 7 at 8 mm/sec along the axial direction of the substrate, and by blasting the abrasives 5 under the blasting pressure of 2 kg/cm$^2$ onto the outer surface of the substrate.

The maximum surface roughness (Rmax) measured by the non-contact method was 2.5 $\mu$m, and the average surface roughness for 10 points (Rz) measured by the contact method was 0.11 $\mu$m.

Comparative example 1 (C1)

A photoconductor of a comparative example 1 was fabricated in the same manner as the photoconductor of the first sample embodiment except that the entire outer surface of the substrate 1 for the comparative example 1 was roughened with alumina abrasives with a grain size of #400 by keeping the nozzle head 7 a distance of 15 cm away from the outer surface of the substrate 1, by moving the nozzle head 7 at 16 mm/sec along the axial direction of the substrate, and by blasting the abrasives 5 under the blasting pressure of 1 kg/cm$^2$ onto the outer surface of the substrate.

The maximum surface roughness (Rmax) measured by the non-contact method was 6.8 $\mu$m, and the average surface roughness for 10 points (Rz) measured by the contact method was 0.23 $\mu$m.

Comparative example 2 (C2)

A photoconductor of a comparative example 2 was fabricated in the same manner as the photoconductor of the first sample embodiment except that the aluminum tubing surface for the substrate of comparative example 2 was not roughened by dry-blasting.

The maximum surface roughness (Rmax) as measured by the non-contact method was 2.5 $\mu$m, and the average surface roughness for 10 points (Rz) as measured by the contact method was 0.07 $\mu$m.

Comparative example 3 (C3)

The aluminum tubing surface for a substrate of a comparative example 3 was not roughened by dry-blasting. Then, a photoconductor of comparative example 3 was fabricated in the same manner as the photoconductor of the second sample embodiment.

The results of the surface measurements of the substrate of the comparative example 3 were the same as those of the substrate surface of the comparative example 2.

The photoconductors of the first through third sample embodiments and comparative examples 1 through 3 were evaluated in terms of color unevenness, pitting defects, occurrence of black spots and voids, printing density unevenness, charge retention and repeatability. The results are listed in Table 1.

| Evaluation Items | | E1 | E2 | E3 | C1 | C2 | C3 |
|---|---|---|---|---|---|---|---|
| Surface Treatment/ Surface states | Dry-blasting | Applied | Applied | Applied | Applied | None | None |
| | Abrasive size | #4000 | #4000 | #1500 | #400 | — | — |
| | Rmax (μm) | 1.1 | 1.1 | 2.5 | 6.8 | 2.5 | 2.5 |
| | Rz (μm) | 0.08 | 0.08 | 0.11 | 0.23 | 0.07 | 0.07 |
| | Degree of oxidation | 80% | 80% | 77% | 82% | 67% | 67% |
| | Wet angle | 25° | 25° | 28° | 30° | 40° | 40° |
| | Adhesiveness | Excellent | Excellent | Excellent | Excellent | Not good | Not good |
| Undercoating layer | | Formed | None | Formed | Formed | Formed | None |
| Photoconductor Properties | Color & luster unevenness | None | None | None | None | Present | Present |
| | Convex defects | None | None | None | Observed | None | None |
| | Black spots and voids | None | None | None | Present | None | None |
| | Printing density unevenness | None | None | None | None | Present | Present |
| | Charge retention | Excellent | Excellent | Excellent | Excellent | Excellent | Excellent |
| | Repeat-ability | Excellent | Excellent | Excellent | Excellent | Excellent | Excellent |

Note: Wet angle was measured with a standard liquid with a wettability index of 500 μN/cm.

As described in Table 1, when a roughening treatment is conducted with alumina abrasives with a grain size of #4000 as in the first and second sample embodiments, an excellent and stable electrophotographic photoconductor, that exhibits a maximum surface roughness of 1.1 μm (which is much lower than 5 μm), a large degree of surface oxidation of 80%, a low wet angle of 25 degrees, and excellent adhesiveness is obtained irrespective of whether an undercoating layer is added or not.

When the roughening treatment is conducted with alumina abrasives with a grain size of #400 as in comparative example 1, the resulting substrate surface is too rough, having a maximum surface roughness of 6.8 μm (which is higher than 5 μm). Convex defects are also observed in the external appearance of the photoconductor, and black spots and voids are present in the printed image.

When a roughening treatment is not employed, as in the comparative examples 2 and 3, the degree of surface oxidation is a relatively low 67%, the wet angle is a relatively large 40 degrees, and the adhesiveness is not relatively good. In addition, unevenness is caused in the color, luster, and printing density.

Effect of the Invention

A fine and regular surface structure is formed on the outer surface of the conductive cylindrical tubular substrate for the electrophotographic photoconductors by the dry-blasting technique according to the invention. By applying the dry-blasting technique of the invention, the finishing work is simplified and a substrate with an excellent surface state is obtained with low manufacturing costs. By using the substrate of the invention, a photoconductive layer with uniform film thickness and film quality is obtained. In addition, a high quality photoconductor, that facilitates preventing color unevenness, luster unevenness, black spots, voids, printing density unevenness, irregular charge retention and poor repeatability is obtained by the employment of a substrate treated by the dry-blasting technique of the invention.

Moreover, by raising the degree of oxidation of the outer surface of the substrate, charge injection is effectively suppressed. The irregular reflection by the properly roughened surface of the substrate facilitates effectively suppressing the interference fringes, which may be caused by the multiple reflections of a monochromatic coherent light with a long wavelength, such as a beam from a semiconductor laser.

We claim:

1. An electrophotographic photoconductor comprising:

an electrically conductive substrate in the form of a cylindrical tube, the substrate having an outer surface roughened by dry-blasting to a maximum surface roughness of about 5 μm or less;

an oxide film on the substrate, the oxide film covering 75 % or more of the outer surface of the substrate; and a photoconductive layer on the oxide film, wherein the substrate has not been preliminarily finished by cutting.

2. The electrophotographic photoconductor of claim 1, wherein the substrate is aluminum.

3. The electrophotographic photoconductor of claim 1, wherein the substrate is an aluminum alloy.

4. The electrophotographic photoconductor of claim 1, wherein the substrate has an inner diameter and a thickness related to each other in a ratio of inner diameter to thickness of 75 or less.

5. The electrophotographic photoconductor of claim 1, further comprising an undercoating layer between the oxide film and the photoconductive layer, the undercoating layer composed substantially of an organic resin and having a thickness of about 5 μm or less.

6. A method of manufacturing an electrophotographic photoconductor, the electrophotographic photoconductor comprising an electrically conductive substrate in the form of a cylindrical tube, the method comprising the steps of:

not preliminarily finishing the outer surface of the substrate by cutting:

roughening by dry-blasting the outer surface of the substrate to a maximum surface roughness of about 5 μm or less using abrasives with a grain size of about #500 or finer;

forming an oxide film on the roughened outer surface of the substrate, the oxide film covering 75% or more of the outer surface of the substrate and forming a photoconductive layer on the oxide film.

* * * * *